US007823285B2

(12) United States Patent
Cai et al.

(10) Patent No.: US 7,823,285 B2
(45) Date of Patent: Nov. 2, 2010

(54) METHOD OF SELECTIVELY ASSEMBLING MULTIPLE CATALYTIC ELEMENTS WITHIN A CATALYTIC CONVERTER HOUSING

(75) Inventors: Haimian Cai, Ann Arbor, MI (US); Richard Harms, Jr., Berkley, MI (US)

(73) Assignee: Automotive Components Holdings, LLC, Dearborn, MI (US)

( * ) Notice: Subject to any disclaimer, the term of this patent is extended or adjusted under 35 U.S.C. 154(b) by 1106 days.

(21) Appl. No.: 11/508,402

(22) Filed: Aug. 23, 2006

(65) Prior Publication Data

US 2008/0052907 A1 Mar. 6, 2008

(51) Int. Cl.
*B21D 51/16* (2006.01)
*F01N 3/28* (2006.01)

(52) U.S. Cl. ..... 29/890; 29/455.1; 422/171; 422/177; 422/222

(58) Field of Classification Search ..... 29/890, 29/455.1, 890.08; 60/299; 422/171, 177, 422/211, 221, 222; 428/592, 593
See application file for complete search history.

(56) References Cited

U.S. PATENT DOCUMENTS 4,750,251 A * 6/1988 Motley et al. ..... 29/890
5,909,916 A 6/1999 Foster et al.
6,635,227 B1 10/2003 Shibata et al.
6,954,988 B2 10/2005 Mayfield
2002/0057998 A1 * 5/2002 Foster et al. ..... 422/179
2006/0045824 A1 3/2006 Foster

FOREIGN PATENT DOCUMENTS

EP 0982480 3/2006
FR 2473623 7/1981
WO WO2007101468 9/2007

* cited by examiner

*Primary Examiner*—A. Dexter Tugbang
*Assistant Examiner*—Livius R Cazan
(74) *Attorney, Agent, or Firm*—Frank L. Lollo; MacMillan Sobanski & Todd, LLC

(57) ABSTRACT

A method is provided for assembling a plurality of catalytic substrates and support materials within a catalytic converter housing using a uniform compression. Outer profiles of a plurality of catalytic substrates are determined. Weight factors of a plurality of the support materials are determined. A lookup table containing a list of associated outer profiles of catalytic substrates and weight factors of support materials are provided. A first catalytic substrate and a first support material are joined as a first pre-assembly based on a matching outer profile and weight factor from the lookup table. A second catalytic substrate and a second support material are joined as a second pre-assembly based on a matching outer profile and weight factor from the lookup table. The first and second pre-assemblies are inserted into the catalytic converter housing. The first catalytic element and the second catalytic element are secured within the catalytic converter housing.

10 Claims, 7 Drawing Sheets

| Substrate Variation | Gap Factor |
|---|---|
| A | 4.2 |
| B | 4.3 |
| C | 4.4 |
| D | 4.5 |
| E | 4.6 |

Fig. 5

| Mat Variation | Weight Factor |
|---|---|
| L | 0.4 |
| M | 0.6 |
| H | 0.8 |

Fig. 6

| Matching Elements | Compression Factor |
|---|---|
| A + H | 5.0 |
| B + H | 5.1 |
| B + M | 4.9 |
| C + M | 5.0 |
| D + L | 5.1 |
| D + M | 5.1 |
| E + L | 5.0 |

Fig. 7

METHOD OF SELECTIVELY ASSEMBLING MULTIPLE CATALYTIC ELEMENTS WITHIN A CATALYTIC CONVERTER HOUSING

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISC APPENDIX

Not Applicable

BACKGROUND OF THE INVENTION

1. Field of Invention

This invention relates in general to catalytic converter assemblies, and more specifically, to a method of selectively matching the catalytic substrate's size to a support material's weight factor.

2. Background of Related Art

Catalytic converters include a catalytic element housed in a metallic housing. The housing typically includes a conical-shaped first end and a conical-shaped second end. The catalytic converters are typically manufactured by cutting a metallic tubular member to a desired length. The catalytic element is pre-wrapped by a support material (i.e., mat) and inserted within the housing. The tubular member is then deformed radially inward so as to compress the outer diameter of the housing to a final preset outside profile dimension.

The support material is compressed between the housing and the catalytic substrate. A typical tolerance of a substrate's outer profile dimension is +/−1 mm. This allows the dimensional variation of a substrate's outer profile dimension to be between 0-2 mm. Meanwhile, there is a +/−10% variation in the support material's weight. Utilizing a known deforming process, for example a swaging process, the housing is deformed only to a preset outside profile dimension which avoids over compression of the housing so as to not fracture the catalytic substrate secured therein.

Since the deforming process deforms the housing only to a preset outside profile, inherent variations of the catalytic elements can affect the performance of the catalytic converter. For example, if the dimensional stack-up of the substrate and the support material is very high prior to assembly, the catalytic substrate may fracture or if the dimensional stack-up is small, then the substrate may move within housing during vehicle operation. In each example, the end result may produce emissions failure.

Methods and apparatus for manufacturing a catalytic converter such as that disclosed in U.S. Pat. No. 6,954,988 determine the fracture characteristics of the substrate and the mat material. The mat and substrate are inserted into the housing as a pre-assembly. The housing (including the mat and substrate) is compressed according to a compression sequence (compression of the housing and mat over the substrate at a respective distance over a respective time) to avoid fracture of the substrate. Due to part to part variation of the components, if a catalytic converter housing requires more than one set of substrates and mat materials, then more than one compression sequence may be required to assure similar compression for each of the sub-assemblies. If such compensation is not made, the first compression sequence is most likely not suitable for securing the second pre-assembly and vice-versa. Utilizing one of the respective compression sequences for both pre-assemblies could result in one or both substrates being loose or fractured.

BRIEF SUMMARY OF THE INVENTION

The present invention has the advantage of utilizing substrates with varying outer profiles and support materials of varying weights within a catalytic converter. Respective substrates are matched with respective support materials such that non-identical substrates and non-identical support materials may be used to form a plurality of catalytic elements within a same catalytic converter housing while applying a substantially similar compression to a predetermined size.

In one aspect of the present invention, a method is provided for assembling a plurality of catalytic substrates and support materials within a catalytic converter housing. Respective outer profiles of a plurality of catalytic substrates are determined. Respective weight factors of a plurality of support materials are determined. A lookup table contains a list of outer profiles of catalytic substrates matched with associated weight factors of support materials. A first catalytic substrate from the plurality of catalytic substrates and a first support material from the plurality of support materials are joined based on a matching outer profile and weight factor from the lookup table as a first pre-assembly for inserting into the catalytic converter. A second catalytic substrate from the plurality of catalytic substrates and a second support material from the plurality of support materials are joined based on a matching outer profile and weight factor from the lookup table as a second pre-assembly for inserting into the catalytic converter. The first and second pre-assemblies are inserted into the catalytic converter housing. The first catalytic element and the second catalytic element are secured within the catalytic converter housing.

In yet another aspect of the present invention, a method is provided for assembling a plurality of catalytic substrates and support materials within a catalytic converter housing. An outer profile of a catalytic substrate is determined. A gap factor between the catalytic converter housing and the catalytic substrate is determined. The support material is weighed. A compression factor is determined based on the gap factor and a weight factor of the support material. A determination is made whether the compression factor is within a predetermined compression threshold. The catalytic substrate and the support material are inserted within the catalytic converter housing in response to the compression factor being within the predetermined compression threshold. An outer profile of a next catalytic substrate is determined. A gap factor between the catalytic converter housing and the next catalytic substrate is determined. The next support material is weighed. A next compression factor is determined based on the next gap factor and a weight factor of the next support material. A determination is made whether the compression factor is within the predetermined compression threshold. The next catalytic substrate and the next support material are inserted within the catalytic converter housing in response to the next compression factor being within the predetermined compression threshold.

Various objects and advantages of this invention will become apparent to those skilled in the art from the following detailed description of the preferred embodiment, when read in light of the accompanying drawings.

BRIEF DESCRIPTION OF THE DRAWINGS

FIG. 5 is a table classifying substrates according to a first preferred embodiment of the present invention.

FIG. 6 is a table classifying support materials according to a first preferred embodiment of the present invention.

FIG. 7 is a lookup table of selectively matched substrates and support materials according to a first preferred embodiment of the present invention.

DETAILED DESCRIPTION OF THE PREFERRED EMBODIMENT

Figure 1:
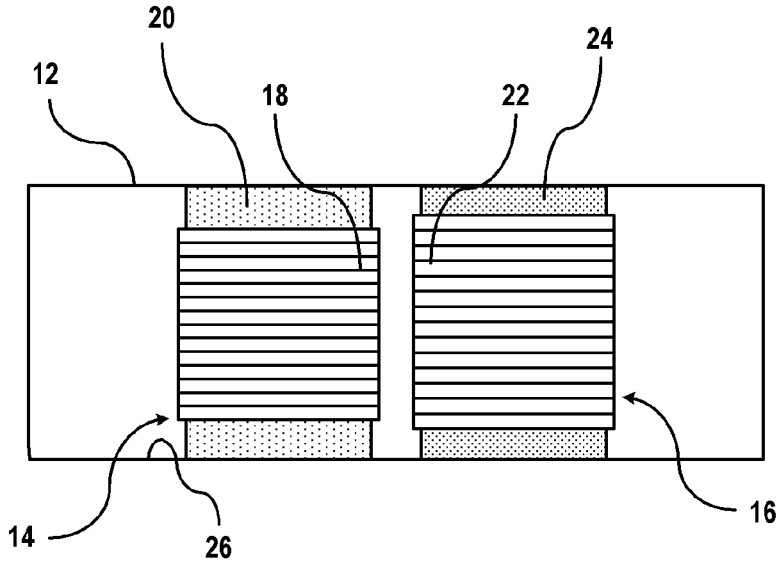
Prior Art Fig. 1
FIG. 1 is a cross-section view of prior art catalytic converter housing.
Figure 2:
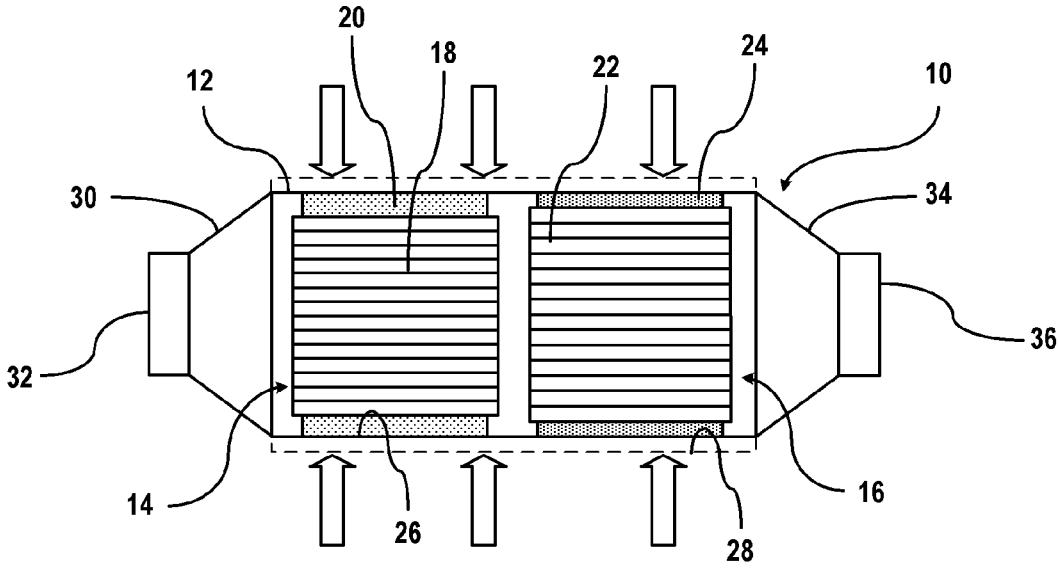
Prior Art Fig. 2
FIG. 2 is a cross-section view of a prior art catalytic converter assembly.

FIGS. 1-2 show a cross section view of a prior art catalytic converter assembly 10 and a housing assembly prior to deforming. The catalytic converter assembly 10 includes a housing 12 formed from a corrosion resistant alloy such as a stainless steel alloy.

The catalytic converter assembly 10 further includes a first catalytic element 14 and a second catalytic element 16. The first catalytic element 14 includes a first substrate 18 and a first support material 20. The second catalytic element 16 includes a second substrate 22 and a second support material 24. An inner surface 26 of the housing 12 is pressed against the first catalytic element 14 and the second catalytic element 16 for securing the first catalytic element 14 and second catalytic element 16 from radial movement therein. The dotted line 28 (shown in FIG. 2) illustrates the initial profile of the housing 12 prior to compression for securing the first catalytic element 14 and the second catalytic element 16 therein.

The catalytic converter assembly 10 includes a first conical-shaped end 30 having a first port 32. The first port 32 is coupled to an exhaust pipe of a vehicle (not shown) extending from an internal combustion engine of the vehicle (not shown). The catalytic converter assembly 10 further includes a second conical-shaped end 34 having a second port 36. The second port 36 is coupled to a next portion of the exhaust system (not shown). The conical ends may be formed by deforming the ends to the housing 12 or separately formed conical ends may be coupled to the housing 12. Alternatively, the housing 12 may not include the conical ends and the housing may be attached directly to the exhaust system.

The first port 32 functions as an inlet port for receiving exhaust gases from the internal combustion engine such has hydrocarbons, carbon monoxide, and nitrogen oxides and converts the exhaust gases into carbon dioxide, water, nitrogen, and oxygen. The second port 36 functions as an exhaust port for discharging the converted gases to the discharging portion of the exhaust system (not shown).

As can be seen in FIG. 1, the first substrate 18 is of a smaller size profile (e.g., diameter) than the second substrate 22. In addition, the second support material 24 is denser (e.g., greater weight) than first support material 20. The larger size profile substrate with the dense support material of the second catalytic element 16 would require less deformation to secure the second catalytic element 16 within the housing 12 than to secure first catalytic element 14 with the smaller size profile substrate and less dense support material. Given the methods of prior art patents, if a compression force of the housing 12 is selected based on securing the first catalytic element 14, then this selected compression force would be too high to secure the second catalytic element 16 without risk of substrate fracture. Alternatively, if the compression force of the housing 12 is selected based on securing the second catalytic element 16, then this selected compression force would be lower than the amount of compression necessary to secure the first catalytic element 14, and therefore, a loose catalytic substrate would likely occur.

Figure 3:
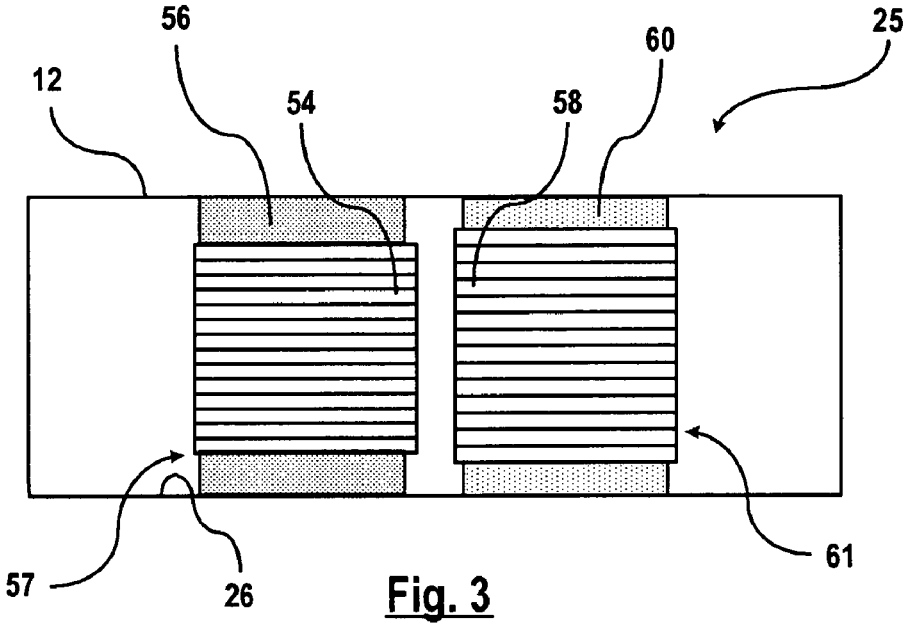
FIG. 3 is a cross-section view of catalytic converter housing according to a first preferred embodiment of the present invention.
Figure 4:
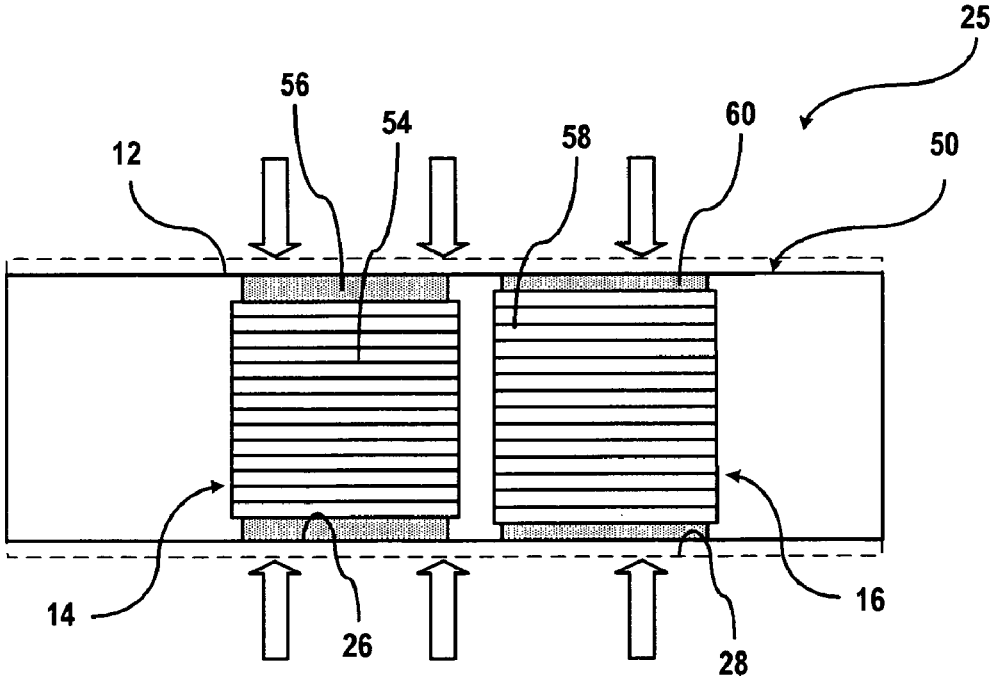
FIG. 4 is a cross-section view of a catalytic converter assembly according to a first preferred embodiment of the present invention.

FIGS. 3 and 4 show a cross section view of a catalytic converter housing assembly 25 of the present invention prior to and after deformation, respectively. The end cones (as shown in FIG. 2) are not shown. A first substrate 54 and a first support material 56 are selected from a plurality of substrates and support materials based on a matching outer profile (of the substrate) and weight factor (of the support material). The first substrate 54 and the first support material 56 are joined by wrapping the first support material 56 around the first substrate 54 as a first pre-assembly for forming a first catalytic element 57.

A second substrate 58 and second support material 60 are selected from the plurality of substrates and support materials based on a matching outer profile and weight factor. The second substrate 58 and the second support material 60 are joined by wrapping the second support material 60 around the second substrate 58 as a second pre-assembly for forming a second catalytic element 61.

The sets of respective substrates and support material selected to form the first and second pre-assemblies allow a predetermined and uniform compression to be applied to the housing 12 to secure the first catalytic element 57 and the second catalytic element 61 therein. Selectively matching substrates and support materials allow a same predetermined and uniform compression to be applied to the portions of the housing 12 overlapping the first catalytic element 57 and second catalytic element 61 for securing the contents therein without applying overcompression or undercompression to the respective substrates therein.

A list of matching substrates and supporting materials may be provided in a lookup table for ease of selection or an algorithm may be used to determine a set of a matching components when either a respective substrate having a determined outer diameter is selected or a respective support material having a determined weight factor is selected.

FIGS. 5-7 illustrate tables for classifying substrates and support materials for selective matching. FIG. 5 illustrates a table classifying a substrate by its gap factor. The gap factor is determined by subtracting the outer profile of a respective substrate from the inner diameter of the housing 12 (shown in FIG. 4). Since the inner dimension of the housing is substantially the same with virtually no variation, the gap factor is determined primarily by the variation of the outer profile of the respective substrates. The smaller the outer profile of the respective substrate the larger the gap factor. The larger the outer profile of a respective substrate, the smaller the gap factor. The outer profile may be determined by various methods such as measuring the diameter, a pass/fail gage, or other method which will provide the size of the substrate. The substrates are classified in FIG. 5 from the smallest gap factor to the largest gap factor.

FIG. 6 illustrates a table classifying respective support materials by their weight factor (e.g., density). The support material is evaluated to identify the weight factor so that a desired pairing may be made with a respective substrate. The support substrates are classified in FIG. 6 from the lowest weight factor to the highest weight factor (e.g., least dense to most dense). The weight factor may be an actual weight or correlated value.

FIG. 7 illustrates a lookup table for matching outer profiles with respective weight factors. The objective is to match a respective substrate with a respective support material such that the combination of the two respective values, known as a compression factor, that produces a target value (e.g., targeted value or targeted range). As shown in FIG. 7, the target value is 5.0 with a +/−0.1 variation. Alternatively, the target value may be a number other than 5.0 and the tolerance may be a value other than +/−0.1. By selectively matching a respective substrate and respective support material so that the target value is maintained within the target range, a predetermined compression force may be applied to each respective housing without the concern of an overcompression or undercompression condition occurring.

The tables of 5-7 are only representative of a single embodiment for determining a match between the respective substrates and the respective support materials, and other values or characteristics may be utilized in place of those shown in the table. For example, in an alternative embodiment, the actual diameter of the substrate may be used in place of the gap factor for determining a respective match. In yet another embodiment, an algorithm may be used to calculate a match as opposed to utilizing a lookup table. It should be appreciated that various methods may be used to determine the match, however, it is the selective matching of a respective substrate with a respective support material that cooperatively allows the plurality of catalytic elements having varying outer profiles and support materials having varying weight factors to be secured within the housings utilizing a substantially same compression.

Figure 8:
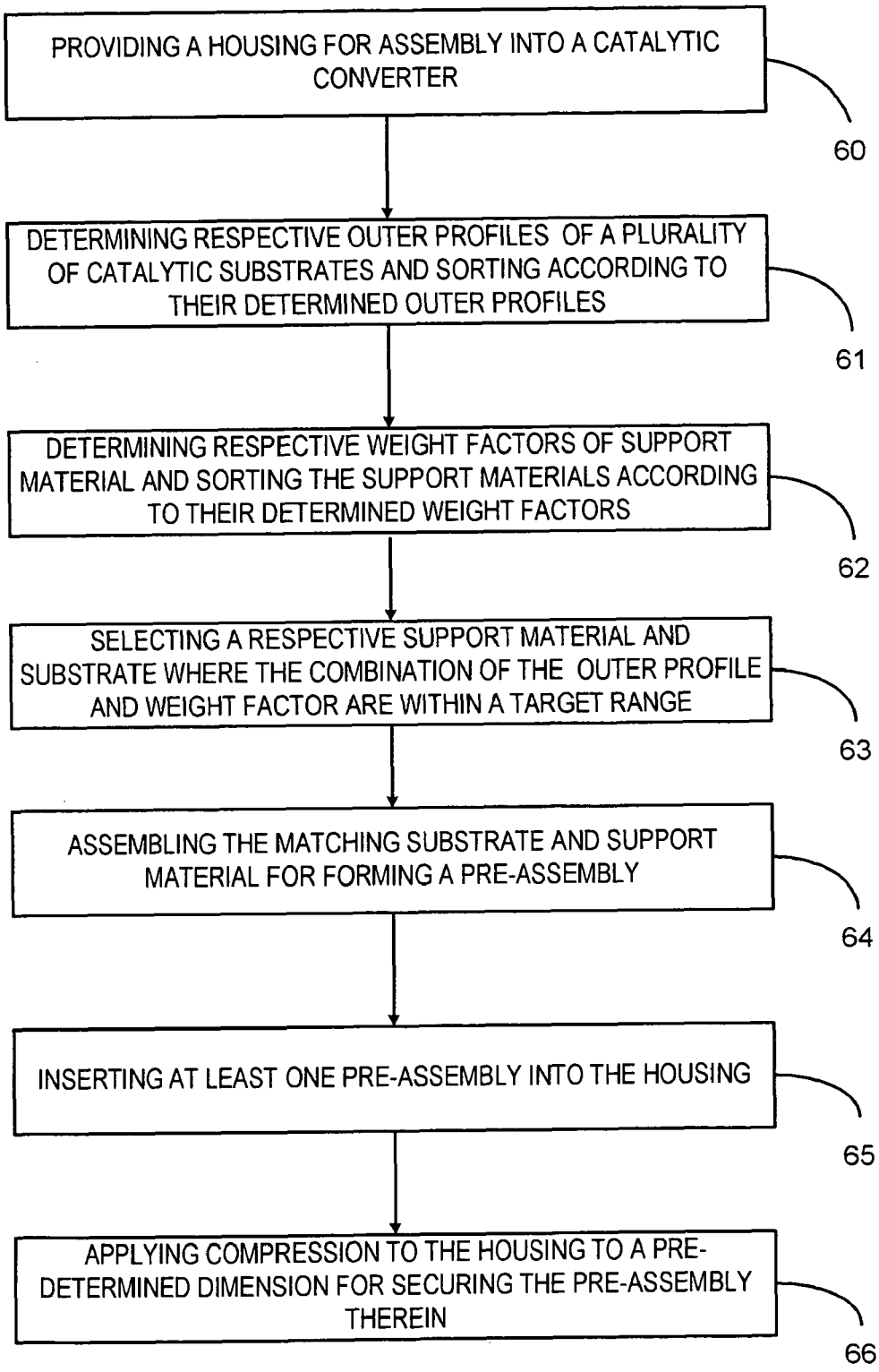
FIG. 8 is a method for matching a substrate and support material according to a first preferred embodiment of the present invention.

FIG. 8 illustrates a method for determining a match between a respective substrate and a respective support material according to a first preferred embodiment. In functional block 60, a housing is provided for assembly into a catalytic converter.

In function block 61, the outer profile of a plurality of substrates is determined and sorted according to their outer profile. Alternatively, the plurality of substrates are pre-sorted (i.e., pre-screened) and provided to an assembly process.

In function block 62, a plurality of supporting materials are evaluated and sorted according to their weight factor. Alternatively, the plurality of support materials may be pre-sorted and provided to an assembly process.

In function block 63, a respective substrate is selected along with a respective support material such that the combination of the associated outer profile (or gap factors) and the weight factor are within a target range.

In function block 64, a pre-assembly is made by wrapping the support material around the substrate.

In function block 65, at least one pre-assembly is inserted into the housing.

In function block 66, the compression is applied to the housing to a predetermined dimension.

It should be appreciated that in the above process, evaluating the weight factor of the support material and the determining the outer profile of the substrate may be done concurrently or at off-line sub-assembly operations.

Figure 9A:
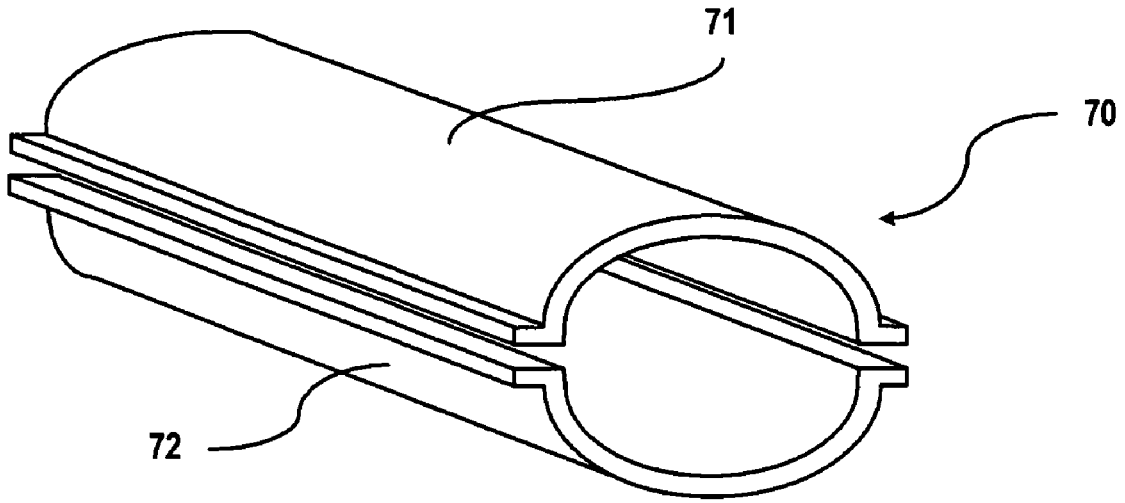
FIGS. 9*a* and 9*b* illustrate a perspective view and a side view, respectively, of a housing used to enclose the matching substrates and the support materials according to a second preferred embodiment of the present invention.
Figure 9B:
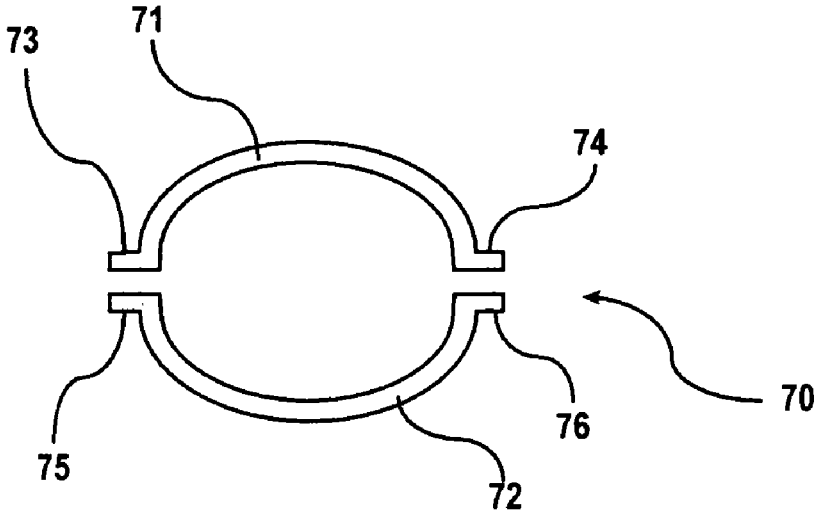

FIGS. 9*a* and 9*b* illustrate a housing used to enclose the substrates and the support material according to a second preferred embodiment. A clamshell-type housing, shown generally at 70, includes a first housing portion 71 and a second housing portion 72. The first housing portion 71 includes a leg portion 73 and a leg portion 74. Leg portions 73 and 74 are substantially flat and extend lengthwise along opposing sides of the first housing portion 71. The second housing portion 72 includes a leg portion 75 and a leg portion 76. Leg portions 75 and 76 are substantially flat and extend lengthwise along the opposing sides of the second housing portion 72. After the substrates and support materials (not shown) are inserted in one of the respect housing portions, the clamshell-type housing 70 is closed. As the first housing portion 71 and the second housing portion 72 are forced together to close leg portions 73 and 75 are in aligned for abutting one another and leg portions 74 and 76 are aligned for abutting one another. As the clamshell-type housing 70 closes, a compression is exerted on the support material and substrates therein by the first housing portion 71 and the second housing portion 72 for securing the respective catalytic elements therein. The abutting leg portions 73 and 75 and abutting leg portions 74 and 76 allow the first housing portion 71 and the second housing portion 72 to compress the supporting materials therein to a predetermined reduced profile. As a result, there is no reduction in size of the housing using the clamshell-type housing as only the support material is compressed.

Figure 10A:
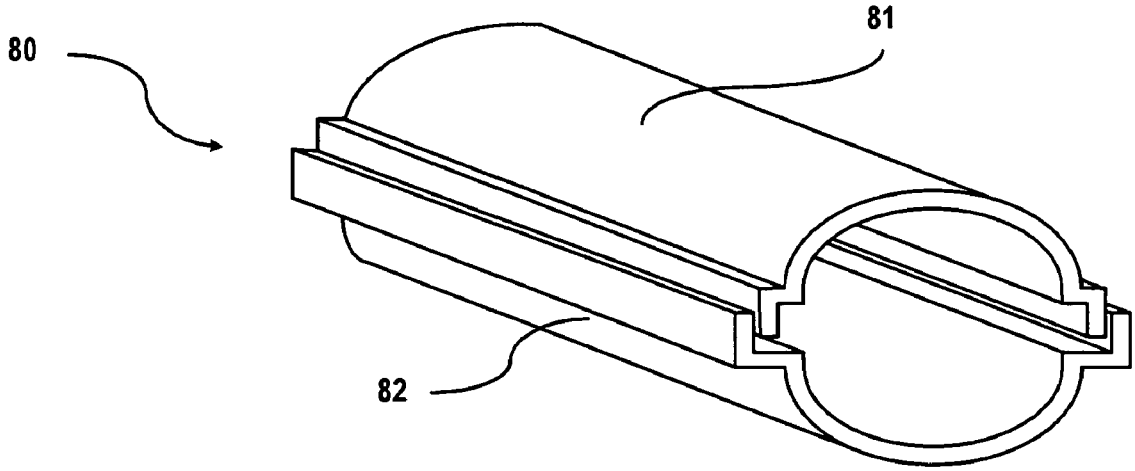
FIGS. 10*a* and 10*b* illustrate perspective view and a side view, respectively, of a housing used to enclose the matching substrates and the support materials according to a third preferred embodiment of the present invention.
Figure 10B:
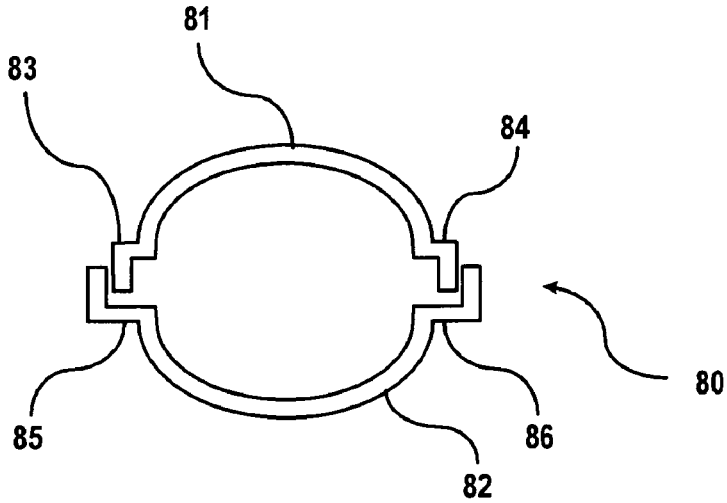

FIGS. 10*a* and 10*b* illustrate a housing used to enclose the substrates and the support material according to a third preferred embodiment. A shoe-box-type housing, shown generally at 80, includes a first housing portion 81 and a second housing portion 82. The first housing portion 81 functions as a lid and the second housing portion 82 functions as a body. The first housing portion 81 includes a leg portion 83 and a leg portion 84. Leg portions 83 and 84 extend in a direction toward the second housing portion 82. The second housing portion 82 includes a leg portion 85 and a leg portion 86. Leg portions 85 and 86 extend in a direction toward the first housing portion 81. The substrates and support materials (not shown) are inserted in the second housing portion 82. The first housing portion 81 is placed over the second housing portion 82 to enclose the catalytic elements therein. A compression is cooperatively exerted on the support material and substrates therein by the first housing portion 81 and the second housing portion 82 for securing the catalytic elements therein. As the first housing portion 81 and the second housing portion 82 compress the contents therein, leg portions 83 and 84 overlap with leg portions 85 and 86, respectively, for variably reducing the size of the shoebox-type housing 80 until the desired size is obtained or a positive stop is reached. As a result, there is no deformation of the housing using the shoebox-type housing as only the support material is compressed.

It should be noted that other types of canning processes may be used without departing from the scope of the invention. For example the same principles and practices may be applied using a tourniquet or stuffing process.

Figure 11:
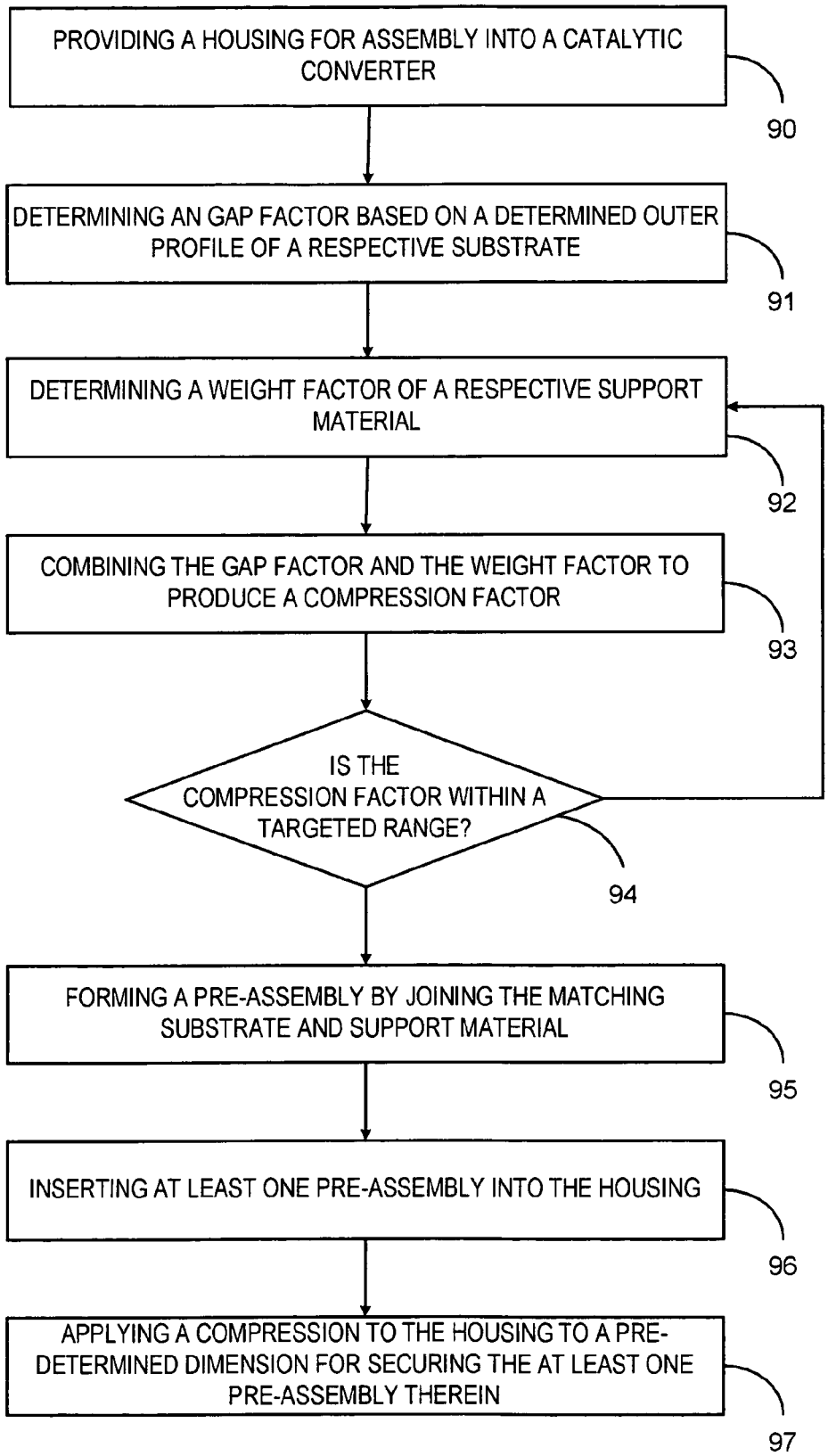
FIG. 11 is a method for matching a substrate and support material according to a fourth preferred embodiment of the present invention.

FIG. 11 illustrates a method for determining a match between a respective substrate and a respective support material according to a fourth preferred embodiment. In functional block 90, a housing is provided for assembly into a catalytic converter.

In function block 91, an outer profile of a substrate is determined. A gap factor is determined based on the outer profile.

In function block 92, a respective support material is assigned a weight factor.

In function block 93, the gap factor and the weight factor are combined to produce a compression factor.

In decision block 94, a determination is made whether the compression factor determined in function block 93 is within a targeted range. If a determination is made that the compression factor is not within the target range, the algorithm returns to function block 92 to select and evaluate a next support material. If the determination is made in decision block 94 that the compression factor is within the predetermined range, then the support material is selected for assembly.

In function block 95, a pre-assembly is formed by wrapping the support material around the substrate.

In function block 96, at least one pre-assembly is inserted into the housing.

In function block 97, the housing is deformed by a deforming process to a predetermined dimension.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A method of assembling a plurality of catalytic substrates and support materials within a catalytic converter housing, the method comprising the steps of:

determining an outer profile of a catalytic substrate;

determining a gap factor between the catalytic converter housing and the catalytic substrate;

weighing the support material;

determining a weight factor based on the measured weight of the support material;

determining a compression factor based on the gap factor and the weight factor of the support material;

determining whether the compression factor is within a predetermined compression threshold;

inserting the catalytic substrate and the support material within the catalytic converter housing in response to the compression factor being within the predetermined compression threshold;

determining an outer profile of a next catalytic substrate;

determining a gap factor between the catalytic converter housing and the next catalytic substrate;

weighing a next support material;

determining a next weight factor based on the measured weight of the next support material;

determining a next compression factor based on the next gap factor and the next weight factor of the next support material;

determining whether the next compression factor is within the predetermined compression threshold; and inserting the next catalytic substrate and the next support material within the catalytic converter housing in response to the next compression factor being within the predetermined compression threshold.

2. The method of claim 1 further comprising the steps of:

securing the catalytic substrate and the next catalytic substrate within the catalytic converter housing.

3. The method of claim 2 further comprising the steps of:

deforming an outer surface of the catalytic converter housing to a predetermined size for compressing the support material and the next support material therein.

4. The method of claim 2 wherein said step of securing the catalytic substrate and the next catalytic substrate includes deforming an outer surface of the catalytic converter housing to a predetermined size.

5. The method of claim 3 wherein the step of deforming the outer surface of the catalytic converter housing compresses the support material and the next support material therein.

6. The method of claim 2 wherein the catalytic converter housing includes a clamshell-type housing and the catalytic substrate and the next catalytic substrate are secured therein by closing the clamshell-type housing.

7. The method of claim 2 wherein the catalytic converter housing includes a first housing portion and a second housing portion and the catalytic substrate and the next catalytic substrate are secured therein by joining the first housing portion and the second housing portion.

8. The method of claim 2 wherein securing the catalytic substrate and the next catalytic substrate within the catalytic converter housing includes stuffing the catalytic substrate and support material and the next catalytic substrate and next support material within the catalytic converter housing.

9. The method of claim 2 wherein the catalytic substrate and the next catalytic substrate are secured within the catalytic converter housing by a substantially same compression acting on the support material and next support material, respectively.

10. The method of claim 2 wherein the catalytic substrate and the next catalytic substrate have a substantially same density after being compressed.

* * * * *